US005820040A

United States Patent [19]

Hockmeyer et al.

[11] Patent Number: 5,820,040

[45] Date of Patent: Oct. 13, 1998

[54] BASKET MEDIA MILL WITH STIRRING RODS AND COUNTERPART STATORS

[75] Inventors: Herman H. Hockmeyer, Saddle River; He Zhu, East Hanover, both of N.J.

[73] Assignee: Hockmeyer Equipment Corp., Harrison, N.J.

[21] Appl. No.: 881,294

[22] Filed: Jun. 24, 1997

Related U.S. Application Data

[63] Continuation-in-part of Ser. No. 574,624, Dec. 19, 1995, abandoned.

[51] Int. Cl.[6] ..... B02C 17/02

[52] U.S. Cl. ..... 241/46.17; 241/74; 241/172

[58] Field of Search ..... 241/171, 172, 241/46.11, 46.17, 74

[56] References Cited

U.S. PATENT DOCUMENTS 4,206,879 6/1980 Geiger .
4,620,673 11/1986 Canepa et al. .
4,730,789 3/1988 Geiger .
5,184,783 2/1993 Hockmeyer et al. .
5,497,948 3/1996 Hockmeyer et al. .

OTHER PUBLICATIONS

Drais DCP Mill, three pages of promotional literature published by Draiswerke, Inc. (undated).
Small Media Mills, eight pages of promotional literature published by Netzsch (undated).

*Primary Examiner*—Mark Rosenbaum
*Attorney, Agent, or Firm*—Arthur Jacob

[57] ABSTRACT

A media basket mill has stirring rods each having a length extending radially into a media bed over a major portion of the radius of the media bed, and static rods juxtaposed with counterpart stirring rods for interacting with the counterpart stirring rods to attain combined attrition and rolling shear within the media bed, the static rods extending radially inwardly from the side wall of the basket along a major portion of the radial length of the counterpart stirring rods, so as to tend to stabilize the media bed in radial directions while increasing the combined attrition and rolling shear attained between the static rods and the counterpart stirring rods, the static rods being affixed either directly to the side wall or to an insert selectively seated within the basket.

10 Claims, 4 Drawing Sheets

BASKET MEDIA MILL WITH STIRRING RODS AND COUNTERPART STATORS

This is a continuation-in-part of application Ser. No. 08/574,624, filed Dec. 19, 1995 now abandoned.

The present invention relates generally to basket media mills and pertains, more specifically, to improvements in a basket media mill which place stators in juxtaposition with counterpart stirring rods in the media bed in the basket of the basket media mill for interacting with the counterpart stirring rods to attain combined attrition and rolling shear within the media bed, and tending to stabilize the media bed in radial directions while increasing the combined attrition and rolling shear attained between the stators and the counterpart stirring rods.

In an earlier patent, U.S. Pat. No. 5,184,783, the disclosure of which is incorporated herein by reference thereto, there are described basket media mills of the type in which a basket containing a bed of grinding media is immersed in a mixture of liquid and solids to be dispersed in the liquid, held within a vessel, and at least one impeller moves the mixture through the basket, and through the bed of media in the basket, to circulate the mixture in the vessel and divide and disperse the solids within the liquid vehicle. In an improvement described in U.S. Pat. No. 5,497,948, the disclosure of which is incorporated herein by reference thereto, more rapid grinding and dispersion is attained by the particular placement of impellers which assist in the movement of the mixture through the wall of the basket.

The present invention provides improvements in basket media mills of the type described above, which improvements attain several objects and advantages, some of which are summarized as follows: Combines attrition with rolling shear in the media bed to increase grinding effectiveness; stabilizes the media bed within at least a portion of the basket of the basket media mill for increased efficiency and better grinding; attains the dispersion of more finely divided solids in a liquid vehicle in less time; increases the efficiency with which solids are finely divided and dispersed in a liquid vehicle, thereby intensifying energy distribution within the media bed; attains mixtures of enhanced and uniform quality with less processing time; reduces clogging and other detrimental effects, thereby attaining more effective operation; readily adapts existing basket media mills for attaining the aforesaid objects and advantages.

The above objects and advantages, as well as further objects and advantages, are attained by the present invention which may be described briefly as an improvement in a media basket mill for dispersing a selected constituent into a liquid vehicle to produce a mixture of the constituent and the liquid vehicle within a mixing vessel, the media basket mill including a basket extending vertically in an axial direction between a top end and a bottom end, a media bed in the basket, a rotor journaled for rotation about the axial direction, the rotor including a hub and stirring rods extending radially in a horizontal direction from the hub into the media bed, the basket having a basket wall for retaining the media bed within the basket and openings in the basket wall for permitting passage of the mixture through the basket wall in response to operation of the impeller means when the basket is immersed in the mixture in the vessel, the basket wall including a horizontal bottom wall at the bottom end and an axially extending vertical side wall having a prescribed internal radius, the media bed being located in an annular space between the hub of the rotor and the side wall of the basket wall, the annular space having a radial width, the openings being located in at least a portion of the side wall and the stirring rods each having a radial length extending radially outwardly from the hub into the annular space along a major portion of the prescribed radius of the side wall, the improvement comprising: a plurality of stators affixed within the basket, stationary relative to the rotating stirring rods, for interacting with counterpart stirring rods to attain combined attrition and rolling shear within the media bed, the stators extending radially inwardly from the side wall of the basket in the horizontal direction toward the hub of the rotor, into the annular space, axially adjacent the counterpart stirring rods, along a major portion of the radial length of the counterpart stirring rods, so as to tend to stabilize the media bed against movement in radial directions horizontally away from the hub while increasing the combined attrition and rolling shear attained between the stators and the counterpart stirring rods. In a preferred arrangement, the side wall includes a first annular side wall portion and a second annular side wall portion located vertically above the first annular side wall portion, and the static rods are located only along the second annular side wall portion. In another preferred arrangement, the static rods are affixed to an insert seated within the basket for selective removal.

The invention will be understood more fully, while still further objects and advantages will become apparent, in the following detailed description of a preferred embodiment of the invention illustrated in the accompanying drawing, in which.

Figure 1:
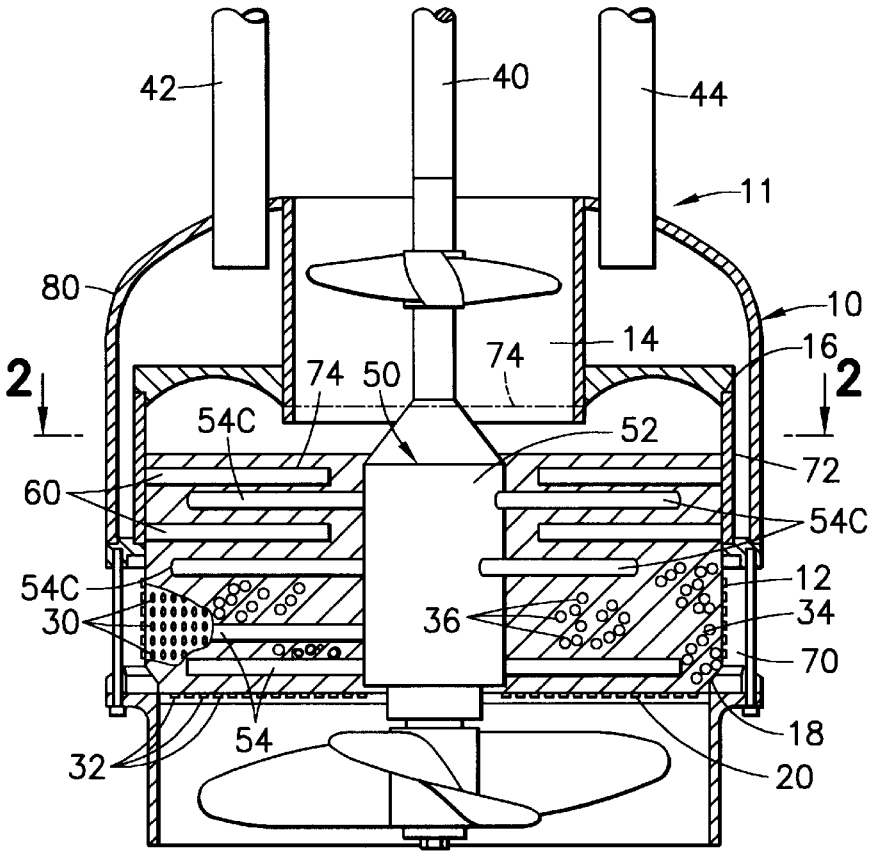
FIG. 1 is a fragmentary diagrammatic longitudinal cross-sectional view of a portion of a basket media mill incorporating an improvement of the present invention.
Figure 2:
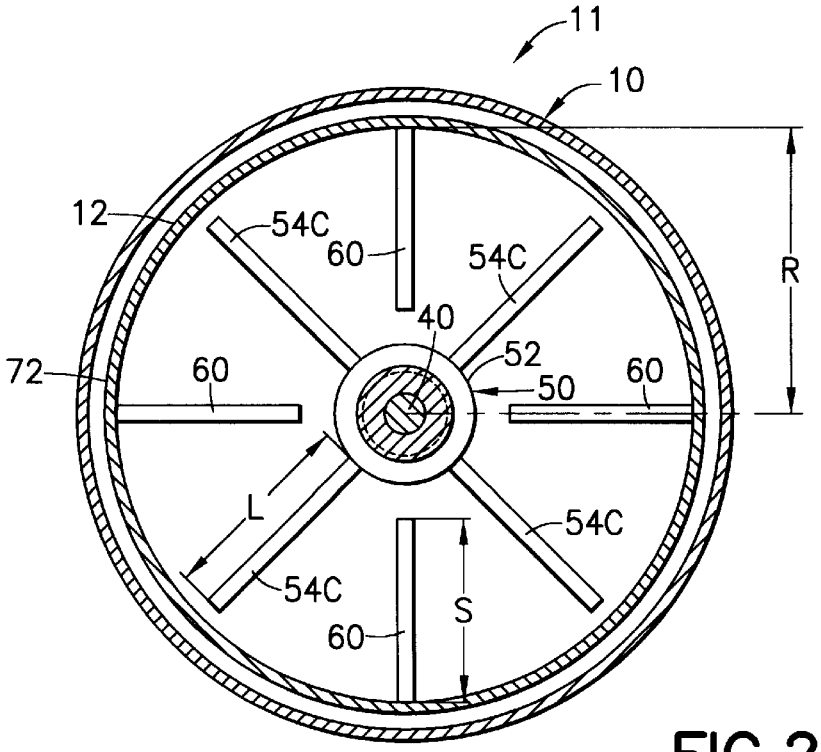
FIG. 2 is an enlarged lateral cross-sectional view taken along line 2—2 of FIG. 1.

Referring now to the drawing, and especially to FIGS. 1 and 2 thereof, a basket 10 of a basket media mill 11 is selectively inserted into a vessel (not shown), as described in the aforesaid patents, so as to be immersed in the contents of the vessel. Basket 10 has a generally cylindrical configuration and includes a cylindrical side wall 12 having a prescribed internal radius R and extending axially from an entrance 14, at upper end 16, vertically to a lower end 18. A bottom wall 20 spans the lower end 18 of the basket 10. The cylindrical side wall 12 of the basket 10 is constructed of a grid-like material having openings shown in the form of axial slots 30 passing radially through the side wall 12. Similar openings in the form of further slots 32 extend axially through the bottom wall 20. A media bed 34 is placed in the basket 10 and preferably is in the form of a mass of discrete media elements illustrated as beads 36. The relative dimensions of the beads 36 and the slots 30 and 32 are such that the media bed 34 is retained in the basket 10. That is, the lateral width of the slots 30 and 32 is no greater than the minimum diameter of the beads 36. In the preferred arrangement, the lateral width of the slots 30 and 32 is approximately one-third the minimum diameter of the beads 36 within the basket 10 so as to facilitate the flow of the contents of the vessel through the basket 10 while preventing the escape of beads 36 from the basket 10.

A drive shaft 40 extends axially through the basket 10 and is journaled for rotation relative to the basket 10. Columns 42 and 44 support the basket 10 and mount the basket 10 in a secure, fixed position within the vessel.

A rotor 50 is carried by the drive shaft 40 and includes a hub 52 and a plurality of stirring rods 54 extending radially outwardly from the hub 52 into an annular space 56 between the hub 52 and the side wall 12 of the basket 10, the annular space 56 having a radial width W, and into the media bed 34 located within the annular space 56. The radial width W of the annular space 56 extends along a major portion of the radius R of side wall 12 and stirring rods 54 each have a radial length L extending along a major portion of radius R of side wall 12. For example, where radius R is about 3 inches, hub 52 has a radius of about 0.75 inch, and the length L is about 2.25 inches. Likewise, the radial width W of the annular space 56 is about 2.25 inches, or about seventy-five percent of the radius R of side wall 12. Stirring rods 54 are arranged circumferentially around and axially along the hub 52. During rotation of the stirring rods 54 with drive shaft 40 and the hub 52, the beads 46 are caused to move with a random up and down motion, rather than moving as a mass only in a rotational motion, and the desired shearing or grinding action is enhanced. Additionally, any tendency toward packing of the media bed 34 and clogging of the slots 30 and 32 is reduced. Generally speaking, approximately ninety percent of the mixing accomplished within the basket media mill 11 takes place within the basket 10.

A plurality of stators are affixed within the basket 10, the stators being shown in the form of static rods 60 affixed to the side wall 12 of the basket 10, as by welding the static rods 60 to the side wall 12, so as to be stationary relative to the rotating stirring rods 54. The static rods 60 are juxtaposed with counterpart stirring rods 54C for interacting with the counterpart stirring rods 54C to attain combined attrition and rolling shear within the media bed 34, the static rods 60 extending radially inwardly from the side wall 12 of the basket 10 and into the annular space 56, toward the hub 52 of the rotor 50, axially adjacent the counterpart stirring rods 54C, along a length S which constitutes a major portion of the radial length L of the counterpart stirring rods 54C, so as to tend to stabilize the media bed 34 in radial directions while increasing the combined attrition and rolling shear attained between the static rods 60 and the counterpart stirring rods 54C. For example, where the radial length L of stirring rods 54 is about 2.25 inches, the static rods 60 extend along about 1.5 inches of radial length L.

In the embodiment illustrated in FIGS. 1 and 2, the side wall 12 includes a first annular side wall portion 70 and a second annular side wall portion 72, the slots 30 in the side wall 12 being located in the first annular side wall portion 70 and the static rods 60 being affixed to the second side wall portion 72. The first annular side wall portion 70 is located axially below the second annular side wall portion 72. In this manner, the mixture entering the basket 10 at the entrance 14 is subjected primarily to intense impact and attrition, due to the presence of the static rods 60 in the upper portion of the basket 10 which includes the second annular side wall portion 72 of the basket 10. As the mixture progresses into the lower portion of the basket 10, which includes the first annular side wall portion 70, the mixture is subjected primarily to rolling shear, due to the absence of static rods 60, and centrifugal forces assist in discharging the mixture through openings 30 in the first annular side wall portion 70. Heat generated by the grinding effected by the intense impact and attrition adjacent the entrance 14 is dissipated by a cooling jacket 80 placed at the entrance 14 of the basket 10.

In comparing the operation of earlier basket media mills, without the static rods, with the operation of the present basket media mill 11 with the static rods 60, it has been observed that the media bed 34 is stabilized along the radius of the media bed 34; that is, centrifugal forces in the earlier basket media mills tend to force the beads of the media bed outwardly, tending to pack the beads more closely together and separating portions of the media bed from the hub 52 of the rotor 50, and forming gaps between the media bed and the hub, whereas in the operation of the present basket media mill 11 the media bed 34 has been observed to remain in contact with the rotor 50, indicating that the beads 36 are not being forced radially outwardly into a tightly packed condition. Moreover, the upper surface 74 of the media bed 34 has been observed to rise upon rotation of the rotor 50, as well as to maintain contact with rotor 50, as indicated in phantom in FIG. 1, indicating that the desired random up and down motion of the beads 36 is accomplished, with radial stabilization of the media bed 34 and without deleterious packing of the beads 36. The observed result is more effective grinding with less elapsed time and greater energy efficiency.

The aforesaid observations have been confirmed by actual laboratory tests in which pigment was ground in a carrier utilizing a standard basket media mill, that is, a basket media mill without stators, and basket media mills within which stators were placed in two different arrangements, in accordance with the improvements of the present invention. In a first test, utilizing a standard basket media mill without stators, a first test batch taken from a pre-mixed volume of pigment in a carrier ran for 2.0 hours to reach a 6.5 Hegman grind. In a second test, stators were located along the second, or upper side wall portion of the side wall of the basket, while the first, or lower side wall portion was free of stators. A second test batch taken from the same pre-mixed volume of pigment in a carrier was run and a 6.5 Hegman grind was reached in 1.25 hours. Hence, the grind was 37.5% faster with the addition of the stators in the second side wall portion. In a third test, stators were located in both the second, or upper side wall portion and the first, or lower side wall portion of the side wall of the basket. A third test batch taken from the same pre-mixed volume of pigment in a carrier was run and a 6.5 Hegman grind was reached in 1.75 hours, slower than the second test, but still 12.5% faster than the first test. Thus, the tests confirm that the use of stators results in an improvement in a basket media mill in that grind time is decreased significantly, and that the placement of the stators in only the upper side wall portion of the basket side wall is even more effective in decreasing grind time.

Moreover, observations during the tests confirmed that the distribution of the beads in the media bed is stabilized by the stators so that the distribution remains more uniform along the radius of the media bed, resisting centrifugal forces tending to urge the beads radially outwardly and more tightly together with a concomitant increase in the density of the media bed in radially outward directions, the more uniform distribution contributing to increased grinding efficiency.

Figure 3:
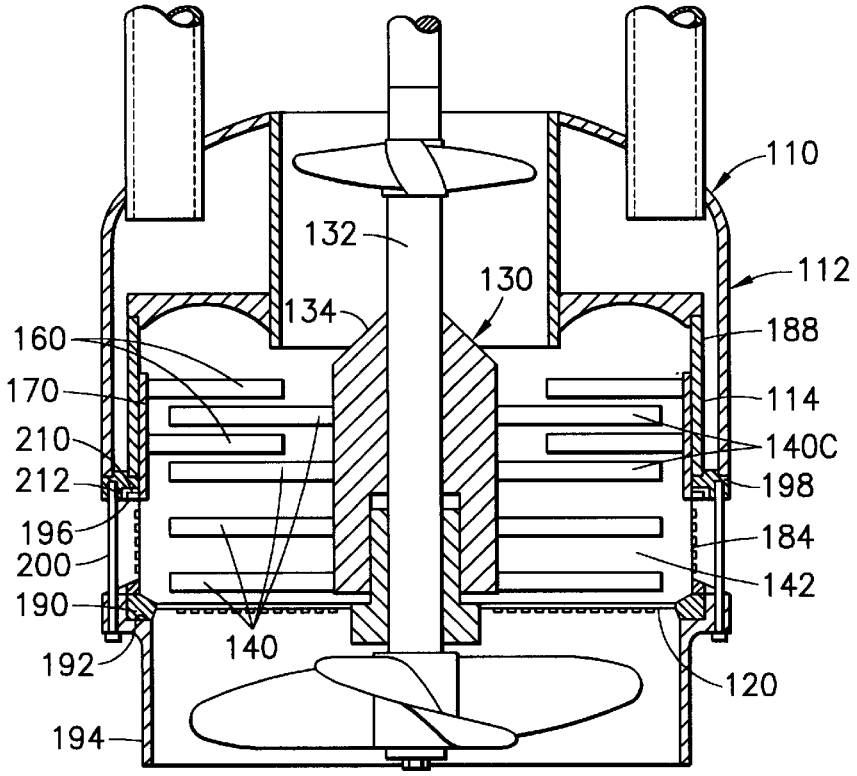
FIG. 3 is a fragmentary diagrammatic longitudinal cross-sectional view similar to FIG. 1 and showing a portion of another basket media mill incorporating another embodiment of the improvement of the present invention.
Figure 4:
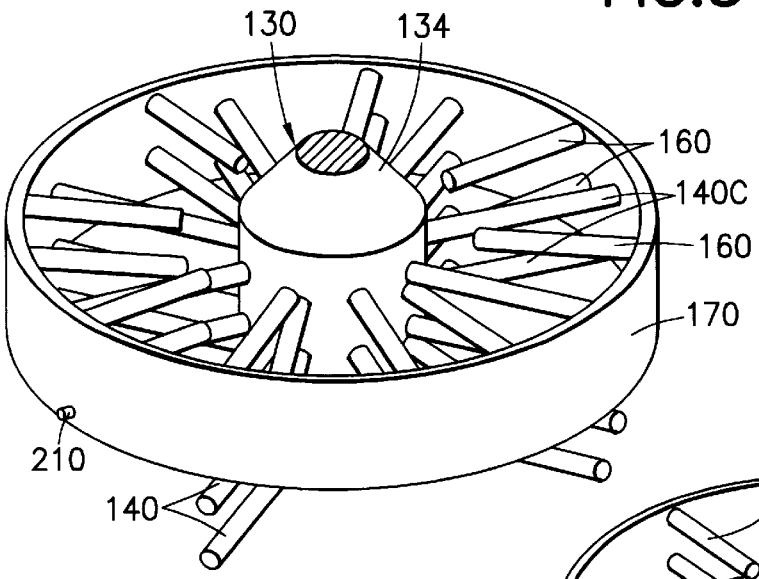
FIG. 4 is a perspective view of component parts of the basket media mill of FIG. 3.
Figure 5:
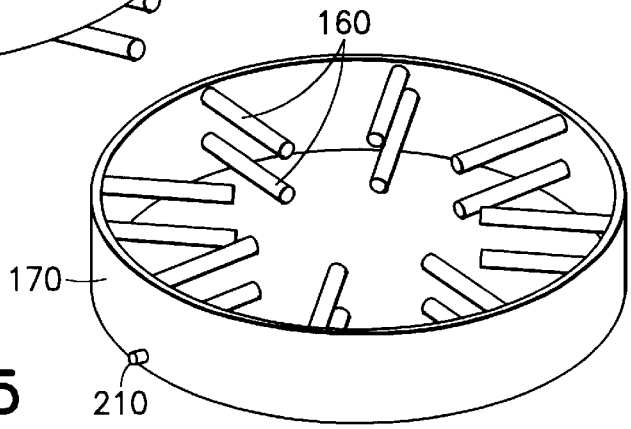
FIG. 5 is another perspective view, reduced in size, of component parts of the basket media mill of FIG. 3.

In the embodiment illustrated in FIGS. 3 through 5, a basket media mill 110 is constructed in a manner very similar to a conventional basket media mill in that basket media mill 110 includes a basket 112 for containing media, a side wall 114 and a bottom wall 120, both of which include a grid-like construction, as described above, and a rotor 130 carried by a drive shaft 132 which includes a hub 134 and a plurality of stirring rods 140 extending radially outwardly from the hub 132 into an annular space 142 between the hub 134 and the side wall 114 of the basket 112.

A plurality of stators are placed within the basket 112, the stators being shown in the form of static rods 160. However, rather than being permanently affixed to the side wall 114 of the basket 112, as by welding or the like, the static rods 160 are affixed to a sleeve 170 fitted into the side wall 114 so as to secure the static rods 160 stationary relative to the rotating stirring rods 140. The static rods 160 are juxtaposed with counterpart stirring rods 140C for interacting with the counterpart stirring rods 140C to attain combined attrition and rolling shear within the media bed, as described above in connection with basket media mill 11. The sleeve 170 together with the static rods 160 comprise an insert capable of being placed within the conventional arrangement provided by basket media mill 110 to convert that conventional arrangement to an arrangement improved through the utilization of stators in combination with rotating stirring rods 140.

Thus, sleeve 170 is generally cylindrical and includes an overall external radius which is complementary to the inside radius of the side wall 114 so as to enable sleeve 170 to be selectively received within the basket 112 and seated within the side wall 114 to provide the basket media mill 110 with stators, and to enable selective removal of the sleeve 170, and the static rods 160, when it is desired to operate the basket media mill 110 without stators. When the sleeve 170 is seated in the side wall 114, sleeve 170 is located above grid-like lower portion 184 of the side wall 114, with the sleeve 170 juxtaposed with upper portion 188 of the side wall 114. In this manner, the static rods 160 are located at the upper portion 188 of the side wall 114 and flow of the mixture through the grid-like lower portion 184 is undisturbed.

As best seen in FIG. 3, sleeve 170 is retained within the basket 112, and seated within side wall 114, by means of a retainer which includes a retaining ring 190 integral with the bottom wall 120 and supported within a recess 192 in draft tube 194 of the basket media mill 110, which retaining ring 190, in turn, supports the grid-like lower portion 184. The grid-like lower portion 184 includes a support ring 196 which abuts the sleeve 170 and retains the sleeve 170 in place. The draft tube 194 is affixed to the housing 196 of the basket media mill 110 by bolts 200. Locator pins 210 on the sleeve 170 are received within complementary slots 212 in the support ring 196 to secure the sleeve 170 against rotation within the housing 198. Sleeve 170 is selectively removed from the basket 112 by removing bolts 200 to drop the retaining ring 190 and release the lower portion 184 of the side wall 114 and the sleeve 170 from the basket 112.

Figure 6:
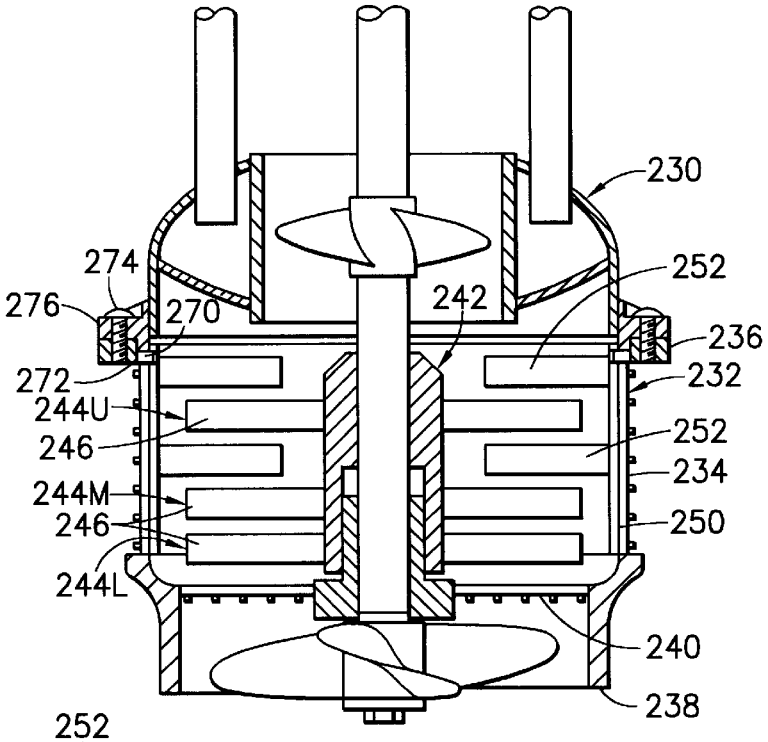
FIG. 6 is a fragmentary diagrammatic longitudinal cross-sectional view similar to FIG. 1 and showing a portion of still another basket media mill incorporating still another embodiment of the improvement of the present invention.
Figure 7:
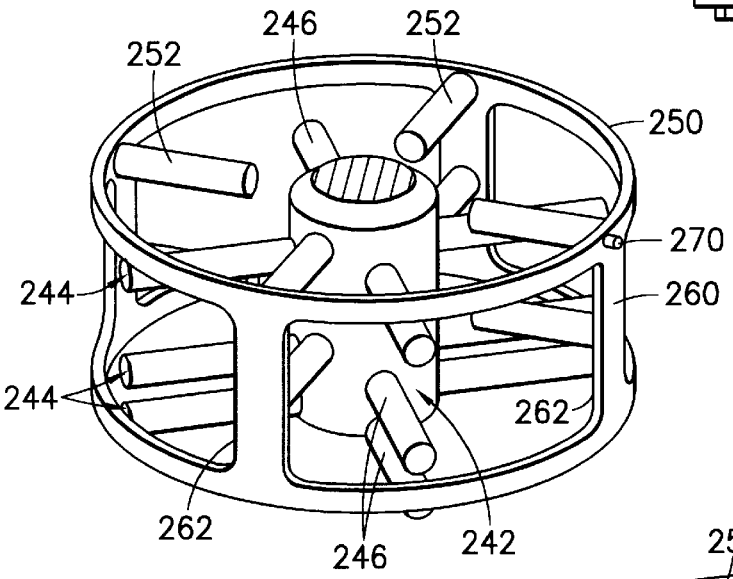
FIG. 7 is a perspective view of component parts of the basket media mill of FIG. 6.
Figure 8:
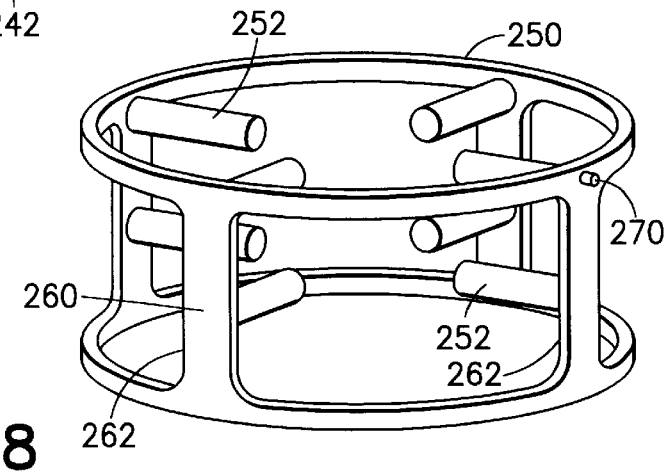
FIG. 8 is another perspective view, reduced in size, of component parts of the basket media mill of FIG. 6.

In the embodiment illustrated in FIGS. 6 through 8, a basket media mill 230 includes a basket 232 having a grid-like side wall 234 extending between an upper flange 236 and a lower draft tube 238. A bottom wall 240 is integrated with the draft tube 238 and has a grid-like construction. A central rotor 242 carries three tiers 244 of four stirring rods 246 each, with the axial spacing between the lowermost tier 244L and the adjacent medial tier 244M being less than the axial spacing between the uppermost tier 244U and the adjacent medial tier 244M.

A sleeve 250 is placed within the basket 232 and carries stators in the form of static rods 252 located vertically just above and just below the uppermost tier 244U, the static rods 252 being affixed to the sleeve 250 along an upper portion 260 of the sleeve 250. Openings 262 in the sleeve 250 are registered with the grid-like side wall 234 along the length of the side wall 234 for enabling flow of the mixture. The outer radius of sleeve 250 is generally complementary with the inner radius of the side wall 234 such that the sleeve 250 is received within the basket 232 to place the static rods 252 as described. The sleeve 250 is retained within the basket 232 by means of a retainer arrangement, as follows: A pair of locator pins 270 project from the sleeve 250 and are received within complementary slots 272 in the upper flange 236. Bolts 274 extend through an upper retaining ring 276 and are threaded into the upper flange 236 to clamp the upper retaining ring 276 against the sleeve 250, thereby securing the sleeve 250 in place against both axial and rotational movements. Sleeve 250 is removed selectively from the basket 232 merely by removing bolts 274, dropping the side wall 234, and then withdrawing the sleeve 250.

Figure 9:
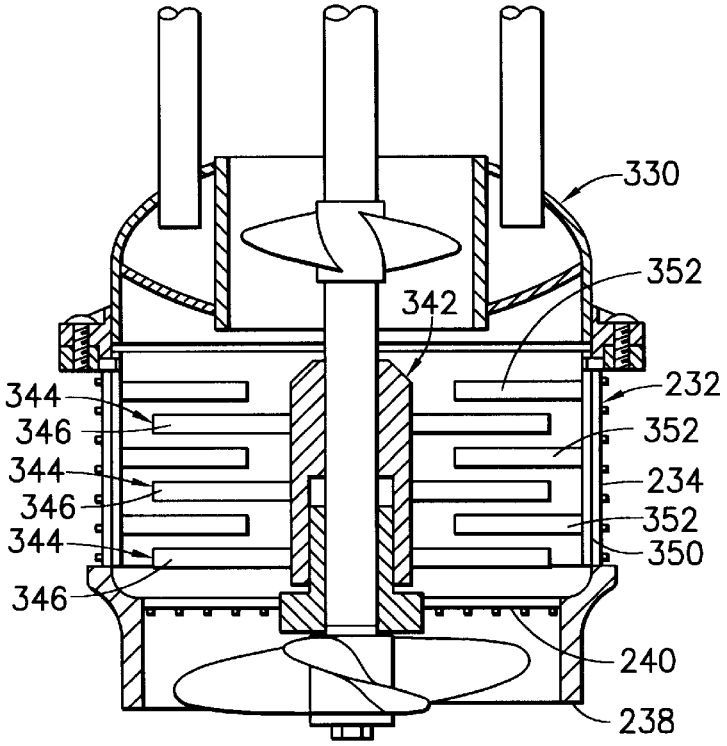
FIG. 9 is a fragmentary diagrammatic longitudinal cross-sectional view similar to FIG. 1 and showing a portion of yet another basket media mill incorporating yet another embodiment of the improvement of the present invention.
Figure 10:
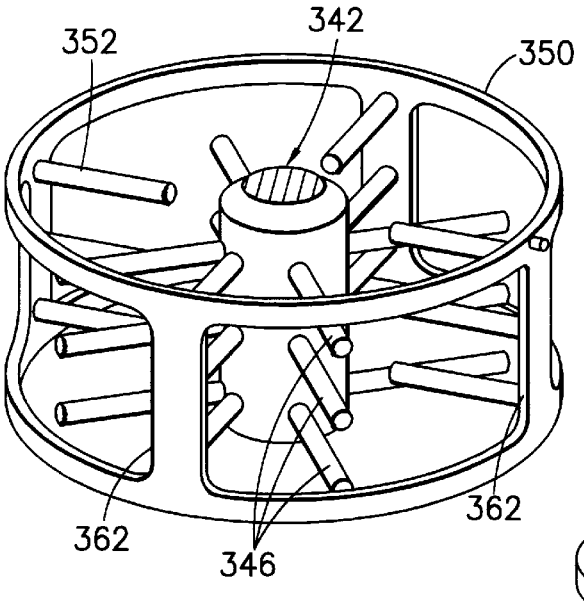
FIG. 10 is a perspective view of component parts of the basket media mill of FIG. 9.
Figure 11:
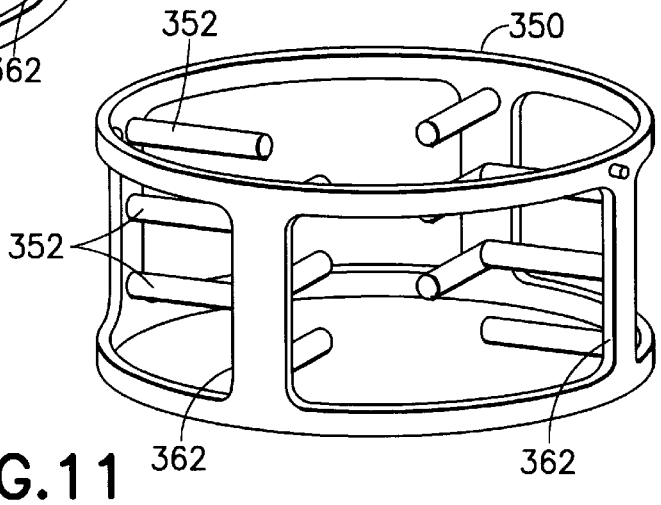
FIG. 11 is another perspective view of component parts of the basket media mill of FIG. 9.

Turning now to the embodiment of FIGS. 9 through 11, basket media mill 330 is constructed similarly to basket media mill 230 and similar component parts have been labelled with the same reference characters. However, in basket media mill 330 the previously described rotor has been replaced with rotor 342 which carries three tiers 344 of four stirring rods 346 each, with the axial spacing between all of the tiers 344 being the same.

A sleeve 350 is placed within the basket 232 and carries stators in the form of static rods 352 located vertically just above each tier 344, the static rods 352 being affixed to the sleeve 350 along the length of the sleeve 350. As before, openings 362 in the sleeve 350 are registered with the grid-like side wall 234 along the length of the side wall 234 to enable flow of the mixture. The outer radius of sleeve 350 is generally complementary with the inner radius of the side wall 234 such that the sleeve 350 is received within the basket 232 to place the static rods 352 as described. The sleeve 350 is retained within the basket 232 by means of a retainer arrangement similar to that described in connection with the embodiment of FIGS. 6 through 8.

It will be seen that the present invention attains the objects and advantages summarized above, namely: Combines attrition with rolling shear in the media bed to increase grinding effectiveness; stabilizes the media bed within at least a portion of the basket of the basket media mill for increased efficiency and better grinding; attains the dispersion of more finely divided solids in a liquid vehicle in less time; increases the efficiency with which solids are finely divided and dispersed in a liquid vehicle, thereby intensifying energy distribution within the media bed; attains mixtures of enhanced and uniform quality with less processing time; reduces clogging and other detrimental effects, thereby attaining more effective operation; readily adapts existing basket media mills for attaining the aforesaid objects and advantages.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a media basket mill for dispersing a selected constituent into a liquid vehicle to produce a mixture of the constituent and the liquid vehicle within a mixing vessel, the media basket mill including a basket extending vertically in an axial direction between a top end and a bottom end, a media bed in the basket, a rotor journaled for rotation about the axial direction, the rotor including a hub and stirring rods extending radially in a horizontal direction from the hub into the media bed, the basket having a basket wall for retaining the media bed within the basket and openings in the basket wall for permitting passage of the mixture through the basket wall in response to operation of the impeller means when the basket is immersed in the mixture in the vessel, the basket wall including a horizontal bottom wall at the bottom end and an axially extending vertical side wall having a prescribed internal radius, the media bed being located in an annular space between the hub of the rotor and the side wall of the basket wall, the annular space having a radial width, the openings being located in at least a portion of the side wall and the stirring rods each having a radial length extending radially outwardly from the hub into the annular space along a major portion of the prescribed radius of the side wall, the improvement comprising:

a plurality of stators affixed within the basket, stationary relative to the rotating stirring rods, for interacting with counterpart stirring rods to attain combined attrition and rolling shear within the media bed, the stators extending radially inwardly from the side wall of the basket in the horizontal direction toward the hub of the rotor, into the annular space, axially adjacent the counterpart stirring rods, along a major portion of the radial length of the counterpart stirring rods, so as to tend to stabilize the media bed against movement in radial directions horizontally away from the hub while increasing the combined attrition and rolling shear attained between the stators and the counterpart stirring rods.

2. The invention of claim 1 wherein the radial width of the annular space is about seventy-five percent of the internal radius of the side wall of the basket wall.

3. The invention of claim 1 wherein the stators comprise static rods affixed to the side wall and extending horizontally in radial directions.

4. The invention of claim 3 wherein the side wall includes a first annular side wall portion and a second annular side wall portion, the openings in the side wall being located in the first annular side wall portion and the static rods being affixed to the second side wall portion.

5. The invention of claim 4 wherein the first annular side wall portion is located vertically below the second annular side wall portion.

6. The invention of claim 5 wherein the radial width of the annular space is about seventy-five percent of the internal radius of the side wall of the basket wall.

7. The invention of claim 1 including:

an insert having an external radius essentially complementary to the internal radius of the side wall of the basket wall for selective reception and seating of the insert within the basket, and for selective removal of the insert from the basket; and a retainer for retaining the insert seated within the basket; and wherein the stators comprise static rods affixed to the insert and extending horizontally in radial directions into the annular space when the insert is seated within the basket.

8. The invention of claim 7 wherein the radial width of the annular space is about seventy-five percent of the internal radius of the side wall of the basket wall.

9. The invention of claim 7 wherein the insert comprises a sleeve having openings in for registration with the openings in the basket wall when the sleeve is seated within the basket.

10. The invention of claim 9 wherein the radial width of the annular space is about seventy-five percent of the internal radius of the side wall of the basket wall.

* * * * *